US006971329B1

(12) United States Patent
Stewart

(10) Patent No.: US 6,971,329 B1
(45) Date of Patent: Dec. 6, 2005

(54) LANE MAKER

(76) Inventor: Robin Hardie Stewart, 3403 Brightwood La., Apt. 9, Woodbridge, VA (US) 22193

( * ) Notice: Subject to any disclaimer, the term of this patent is extended or adjusted under 35 U.S.C. 154(b) by 0 days.

(21) Appl. No.: 10/804,055

(22) Filed: Mar. 19, 2004

Related U.S. Application Data

(60) Provisional application No. 60/455,579, filed on Mar. 19, 2003.

(51) Int. Cl.[7] ..... E01F 9/00

(52) U.S. Cl. ..... 116/63 C; 116/63 P; 404/6; 404/9; 40/612

(58) Field of Search ..... 116/63 C, 63 R, 116/63 P, 63 T, 209; 404/6, 9; 40/612, 903; 33/1 G

(56) References Cited

U.S. PATENT DOCUMENTS

| | | | | |
|---|---|---|---|---|
| 3,917,231 | A * | 11/1975 | Fink | 256/64 |
| 4,256,050 | A * | 3/1981 | Barnard | 116/63 C |
| 4,515,499 | A | 5/1985 | Furiate | |
| 4,573,109 | A | 2/1986 | Lack | |
| 4,770,495 | A | 9/1988 | Lees | |
| 5,030,029 | A | 7/1991 | Johnsen | |
| 5,350,330 | A | 9/1994 | Platis | |
| 5,501,429 | A | 3/1996 | Sakuma | |
| 5,529,429 | A | 6/1996 | Pelegrin | |
| 5,722,611 | A | 3/1998 | Schmid et al. | |
| 5,722,788 | A | 3/1998 | Bent et al. | |
| 5,760,686 | A * | 6/1998 | Toman | 340/540 |
| 6,053,657 | A | 4/2000 | Signorelli | |
| 6,142,701 | A | 11/2000 | Falcon | |
| 6,338,311 | B1 | 1/2002 | Ho | |
| 6,430,819 | B1 * | 8/2002 | Aldstadt et al. | 33/1 G |
| 6,499,858 | B2 * | 12/2002 | Hart | 362/183 |
| 6,512,451 | B1 * | 1/2003 | Eslambolchi et al. | 340/425.5 |
| 6,517,280 | B2 * | 2/2003 | Carter | 404/6 |
| 6,556,147 | B1 | 4/2003 | Fisher et al. | |
| 6,558,068 | B1 | 5/2003 | Wittig | |
| 6,681,715 | B2 * | 1/2004 | Wood | 116/63 P |
| 2002/0062780 | A1 * | 5/2002 | Chen | 116/63 P |
| 2003/0033742 | A1 * | 2/2003 | Perelli et al. | 40/606 |
| 2004/0060499 | A1 * | 4/2004 | Penque, Jr. | 116/63 P |

FOREIGN PATENT DOCUMENTS

| | | | | |
|---|---|---|---|---|
| GB | 2214209 A * | 8/1989 | | E01F 09/00 |

* cited by examiner

*Primary Examiner*—Christopher W. Fulton
*Assistant Examiner*—Amy R. Cohen
(74) *Attorney, Agent, or Firm*—Lawrence R. Franklin

(57) ABSTRACT

A collapsible traffic control cone includes a lane marker for delineating lines of demarcation between lanes approved for traffic flow and areas where traffic is prohibited. When in use, the lane marker extends from a rotatable housing mounted on one of the cones and is releasably attached to an anchor on an adjacent cone. The lane marker is a flat, highly reflective web which lies flat on the roadway between the cones. In the event of a cone being tipped over from its base or when not in use, the lane marker retracts into its housing. A light responsive to oncoming traffic is also provided.

19 Claims, 11 Drawing Sheets

LANE MAKER

RELATED APPLICATIONS

Benefit of Provisional Application Ser. No. 60/455,579, Titled "Delineator Safety Attachment System [Temporary Lane Maker]", filed Mar. 19, 2003, is hereby claimed.

BACKGROUND OF THE INVENTION

1. Field of the Invention

This invention relates to a collapsible traffic control cone with a rotatable lane marker for delineating lines of demarcation between lanes approved for traffic flow and areas where traffic is prohibited. A plurality of cones become a new lane maker, when they are connected together by releasably attaching the rotatable lane marker of each cone to an anchor on its adjacent cone.

2. Description of Related Art

A common site on the highways of our country is a line of traffic control cones (hereinafter, "cone" is considered generic to other similar traffic control entities, e.g., barrels) for diverting and guiding traffic by delineating lanes around obstacles or work-in-progress. Bringing the cones to the site and setting them up is more difficult and time consuming than the casual motorist realizes. Usually, one sees a Department of Transportation worker lifting individual hollow cones from a nested pile on the back of a slowly moving flatbed truck and sequentially placing them on the roadway. If all that is needed is a general indication of separation between traffic flow and work area, then this method is quite efficient, which explains its popularity.

In the situation just described, the line of demarcation between the permitted and the forbidden exists only in the mind of the oncoming driver who must mentally connect the cones with an imaginary fence. This is fine where it is not critical or dangerous that an occasional car cross into the restricted area, e.g., when the object is to funnel traffic into one or more restricted lanes to avoid a work-site located well down the highway. But, there are times when circumstances require a more restrictive control, when it is not enough to rely upon an imaginary line, when a physical connection between cones must be provided.

In order to positively cordon off a potentially dangerous location, when traffic must be prevented from entering a restricted zone, the prior art has attached webs or planks to adjacent cones to provide a physical barrier. See the U.S. patents of record to Lees, Johnsen, Signorelli, Falcon, and Oshima, which are representative of the art in the field. In each case, the cones must be put in place and then either rotated or otherwise specifically fitted to allow attachment of the interconnecting barriers, adding to the time and labor required to set up the barrier.

Other scenarios require more than an imaginary fence but less than a physical barrier. For example, the line must be dramatically more visual, when the safety of workers requires that the general public be prohibited from crossing beyond the cones, but construction trucks and worker's cars must cross the line in order to carry out their duties. That is, positive lane markers must be visually provided which show that crossing them is forbidden, while at the same time physically permitting authorized vehicles to cross them without have to stop to remove and replace the barriers.

Also, the new traffic pattern created by unconnected traffic cones is often not clear to an approaching motorist. The arrangement of cones as seen from a distance can be confusing as to which cones are connected by the imaginary lines. The lane markers of the disclosed lane maker positively connect the plurality of traffic cones in such a way that the boundaries of the new traffic pattern are less ambiguous and thus are clearly understood from further away.

Another example of where positive lane markers are needed between traffic control cones is when traffic patterns are changed such that oncoming traffic must run over lanes previously allotted to ongoing traffic. Usually, traffic cones are combined with temporary "white lines" which are painted to show the new lanes. Being related only by temporary placement of the cones, the new lanes are confusing when one or more cones have been moved. Also, after the work has been completed and the traffic pattern has been restored to its original paths, the temporary "white lines" often remain which can be confusing to the motorist. The alternative, disclosed in the U. S. patent to Furiate, of record, is to lay down a thick lane marker and add traffic control posts periodically therealong. The former is not cost effective, and assembly, disassembly, and storage of Furiate's lane marker is obviously quite time consuming and expensive.

A subsidiary problem with traffic control involves the ability of the motorist to see the line of cones. After dark or during inclement weather, the presence of traffic control cones are often not seen soon enough to avoid collisions with them. The prior art has responded by adding lights to the cones. Representative are the U.S. patents to Lack, Oshima, Fisher et al., and Wittig, of record. These are better than non-lighted cones, but they fail to call attention to the new lanes designated by the line of cones. The instant invention calls attention to the lane markers by the placement of the lights at the base of the cones, drawing the attention of the motorist down to the lane markers themselves.

Aside from DOT workers' safety, another very important area of interest is the personal safety of ordinary motorists. When a motorist has an automotive problem, be it a flat tire or a stalled engine, he is often stuck alongside a road or highway with no adequate shoulder on which to safely park. The motorist then becomes at risk of being struck by a passing car whose driver did not see the problem in time. A few motorists carry flares or foldable, reflective triangles to signal oncoming traffic of the problem. While flares are highly visible, they burn out quickly, often before the vehicle has been fixed. If no more are available, the motorist is again at risk. The reflective triangles are usually stored in a location which is difficult to reach, they are easily broken, and they take considerable time to assemble and put in position. The collapsible cones disclosed herein are more easily stored, retrieved, and operationally assembled.

A few other inventors have recommended the use of traffic safety cones for ordinary motorists. See Pelegrin and Ho, of record, for instance. In both patents the cone is collapsible for storage and for ease in making it operational, but neither provide a positive lane marker to more clearly define the danger area.

All of the prior solutions to the traffic safety problem are complicated, costly, and labor intensive. While useful for their intended purposes, none have provided the convenience, flexibility, and increased safety of the disclosed invention.

SUMMARY OF THE INVENTION

The present invention comprises a traffic cone which is collapsible for ease in storage and transportation thereof, which includes an illumination device responsive to oncoming traffic to aid in seeing and responding to the presence of the cone, and a reflective, interconnecting lane marker which is quickly and easily provided between adjacent cones regardless of their relative angular orientations.

OBJECTS OF THE INVENTION

It is an object of the invention to provide a traffic cone which is easily stored and transported.

It is a further object of the invention to provide a traffic cone which is more easily set up and taken down than similar prior cones.

It is a further object of the invention to provide a traffic cone which includes a retractable lane marker.

It is a further object of the invention to provide a traffic cone which includes a light module comprising a sensor, electronic control circuitry, and a light.

It is a further object of the invention to provide a traffic cone in which a light is positioned to illuminate a reflective, retractable tape.

It is a further object of the invention to provide a traffic cone which includes a rotatable, retractable lane marker.

It is a further object of the invention to provide a traffic cone which includes a rotatable, retractable lane marker which lies flat on the road to permit travel thereover without damage.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENT

Figure 1:
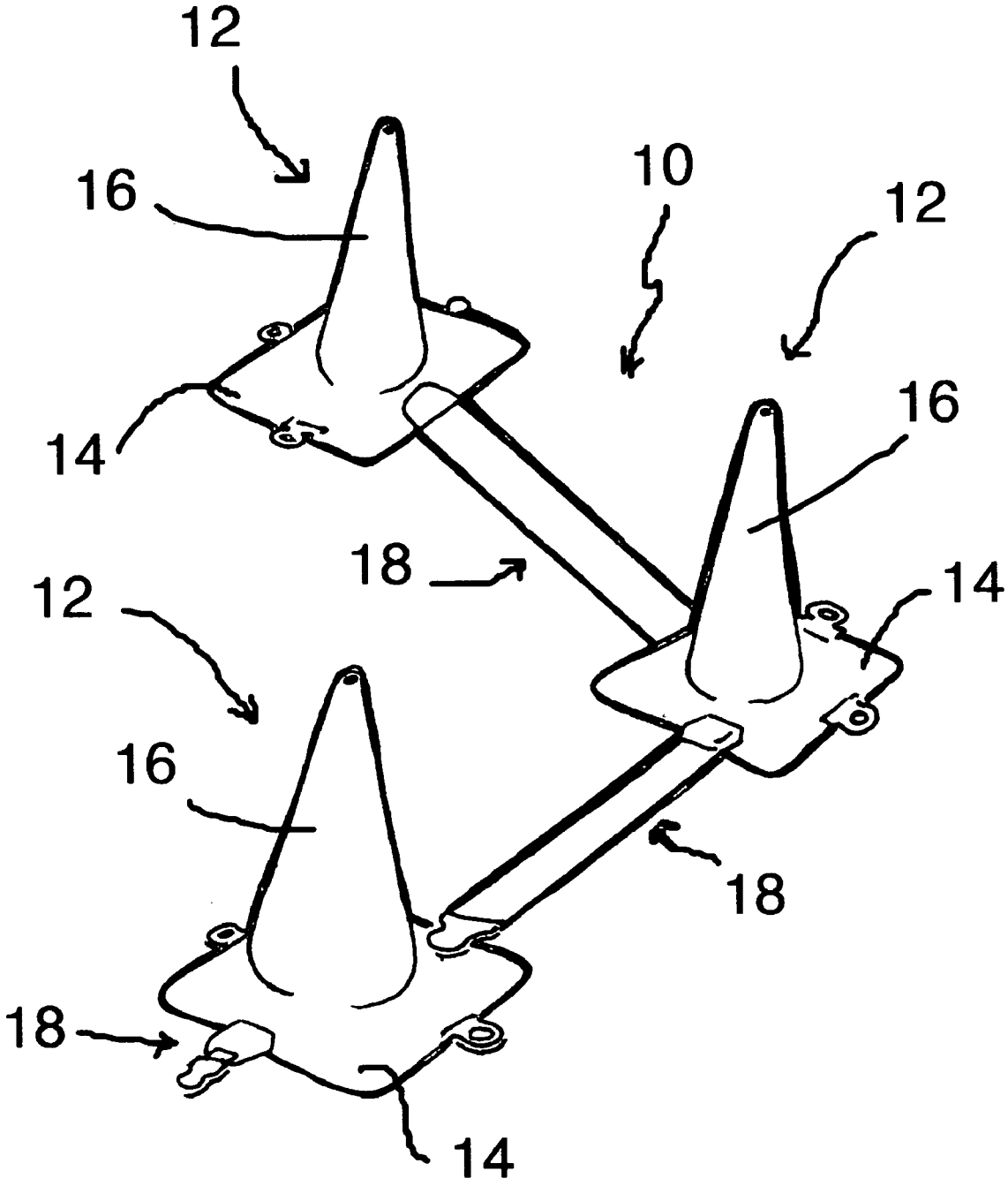
FIG. 1 is a perspective view which illustrates a traffic control lane maker comprising a plurality of the preferred traffic cones of the invention.

Referring now to the FIG. 1, a traffic control lane maker 10 comprises a plurality of traffic cones 12 arranged and interconnected together so as to create a lane designating boundary for a new traffic pattern. The boundary is physically delineated to be more clearly and positively seen.

Each of traffic cones 12 comprise a substantially square, relatively planar base 14 and a generally conical cap 16. Preferably, traffic cones 12 are made of the usual traffic cone materials and, in the basic embodiment of the invention, are colored in the usual manner. It is within the scope of the invention, however, to make them of other materials and/or other colors. For example, they may be color coded to indicate the type of activity from which the traffic is being separated: (1) red for emergencies, such as stalled cars, collapsed bridges or roadways, downed electrical lines, etc.; orange as now usually associated with official Department of Transportation road repairs; green for utility work; and blue for fire or police involvement. The color coding standards are contemplated as being the result of Federal, State, and local agreements and would be universal enough for motorists to be able to recognize the situation confronting them. A constant requirement, however, is that they be durable and highly visible, e.g., including but not limited to reflective, fluorescent, and iridescent.

According to the invention, when a plurality of cones 12 are placed on a roadway, provision is made to connect adjacent cones 12 by positive lane markers 18.

Figure 2:
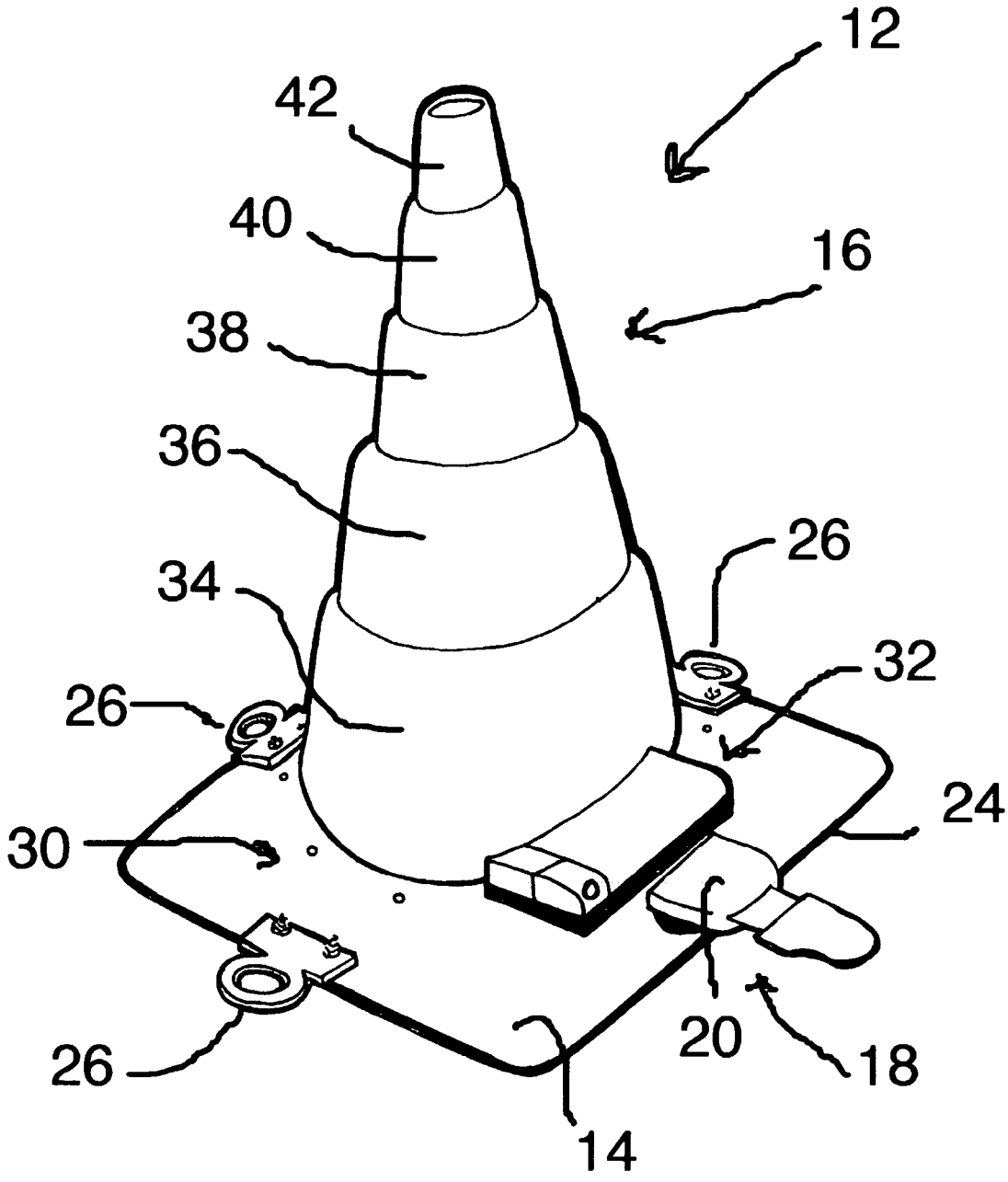
FIG. 2 is a perspective view of a preferred embodiment of a traffic control cone as used in the lane maker of FIG. 1.
Figure 3:
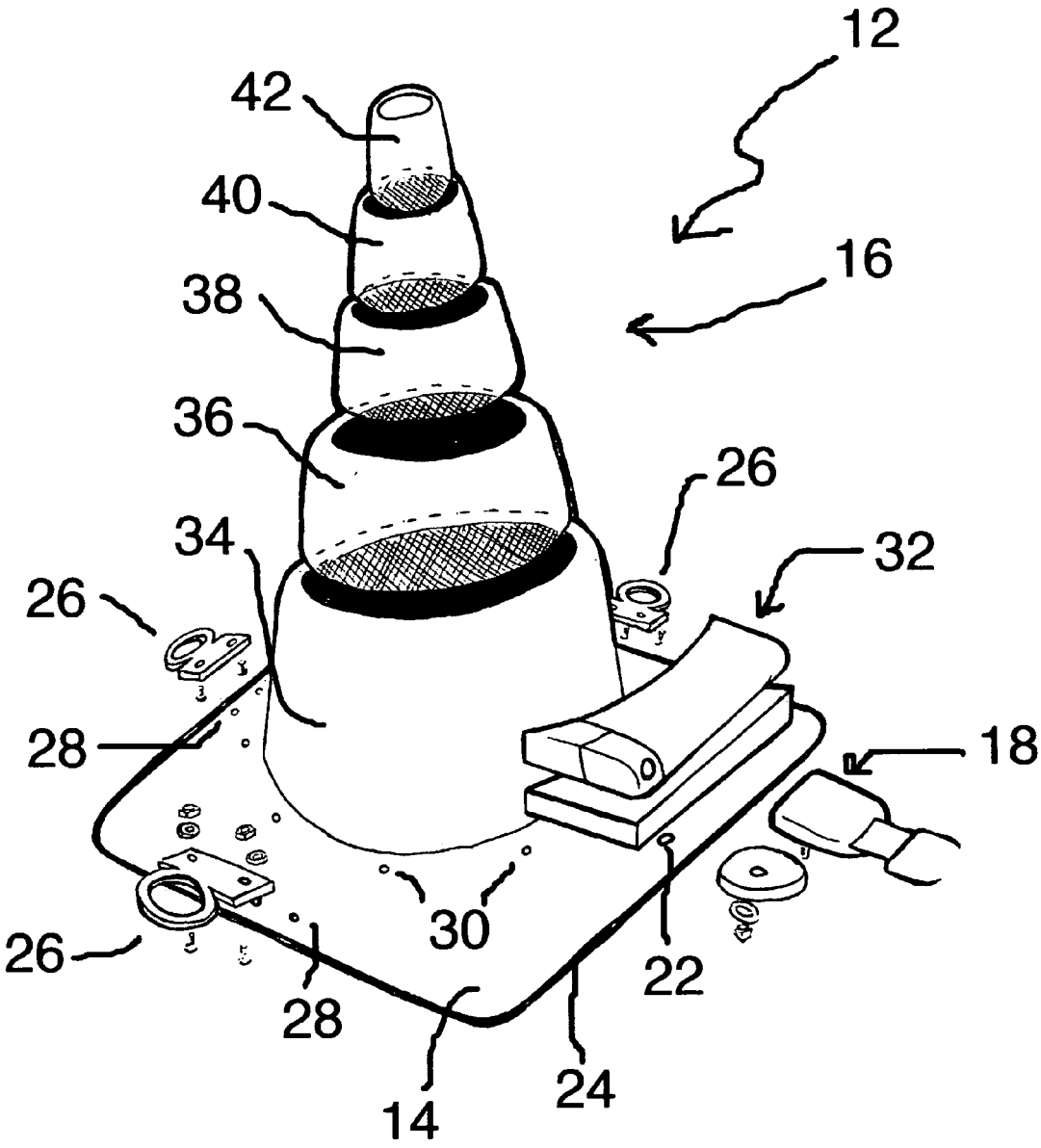
FIG. 3 is an exploded perspective view of the cone of FIG. 2.

FIGS. 2–3 show a preferred embodiment of the invention in assembled and exploded views, respectively.

Lane marker 18 includes a lane marker housing 20 which is mounted to base 14 through an aperture 22 (FIG. 3) formed through base 14 of cone 12 closely adjacent to perimetrical edge 24 thereof. Lane marker anchors 26 are attached to base 14 adjacent to other sides of edge 24 through other apertures 28, as shown. While base 14 is preferably square, other perimetrical shapes are within the purview of the invention. A circular base with lane marker and anchors spaced substantially ninety-degrees apart would work as well. The structural details and coactions of lane marker 18 and anchors 26 will be discussed later relative to FIGS. 8–12.

Figure 7:
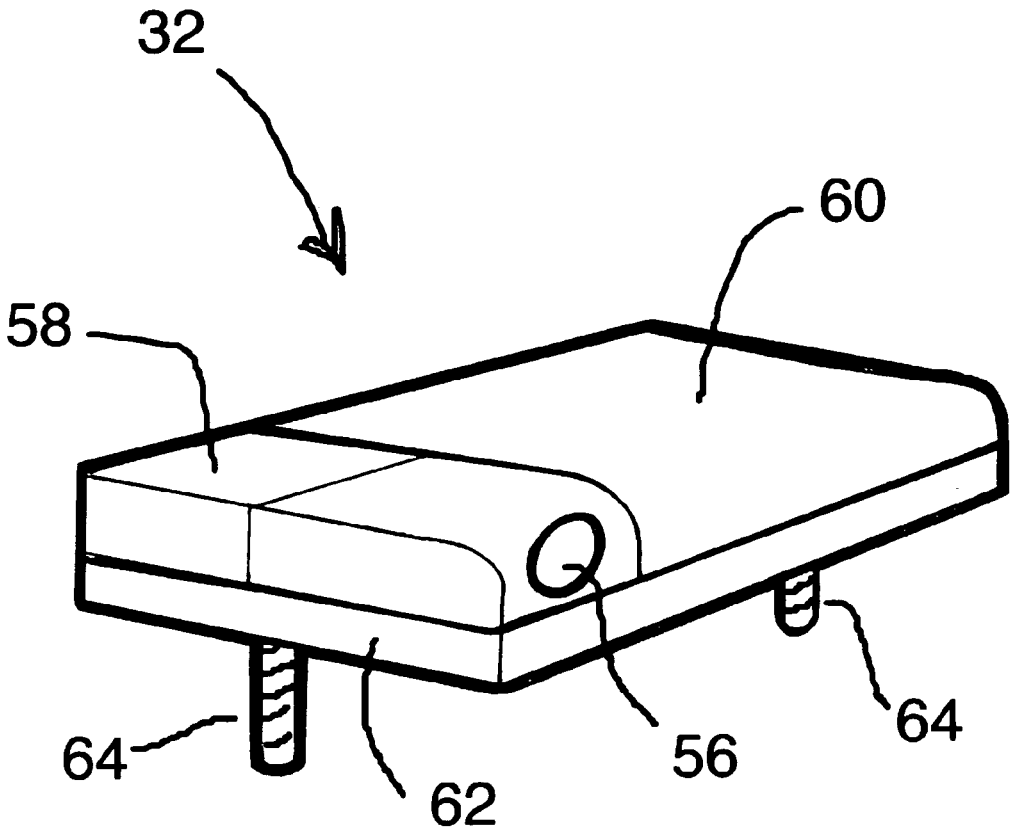
FIG. 7 is a perspective view of a light module for use with the invention.
Figure 8:
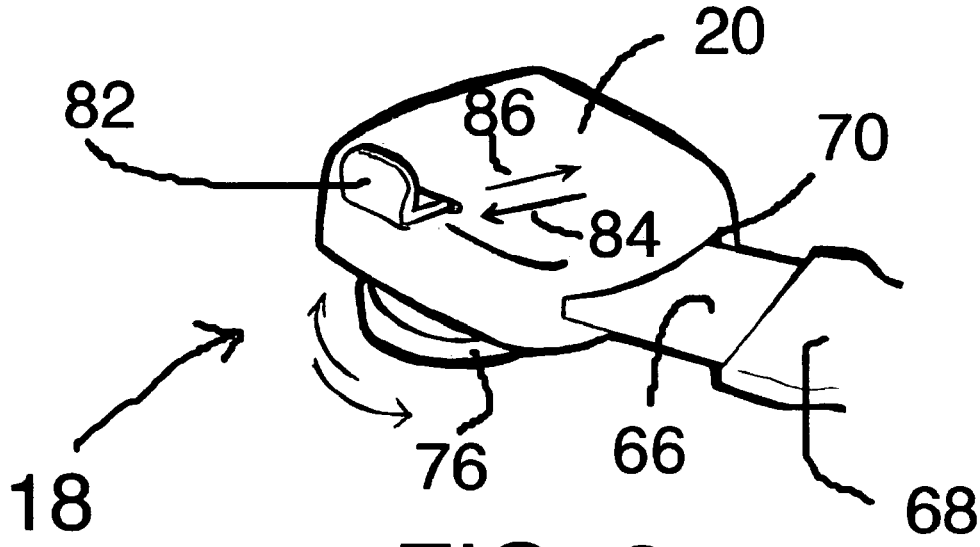
FIG. 8 is a perspective view of a lane marker which is a part of the cones of FIG. 2.

Other apertures 30 are formed through base 14 of cone 12 closer to cone 16. A light module 32, which will be discussed in detail shortly relative to FIG. 7, is optionally attached to base 14 via apertures 30.

Figure 4:
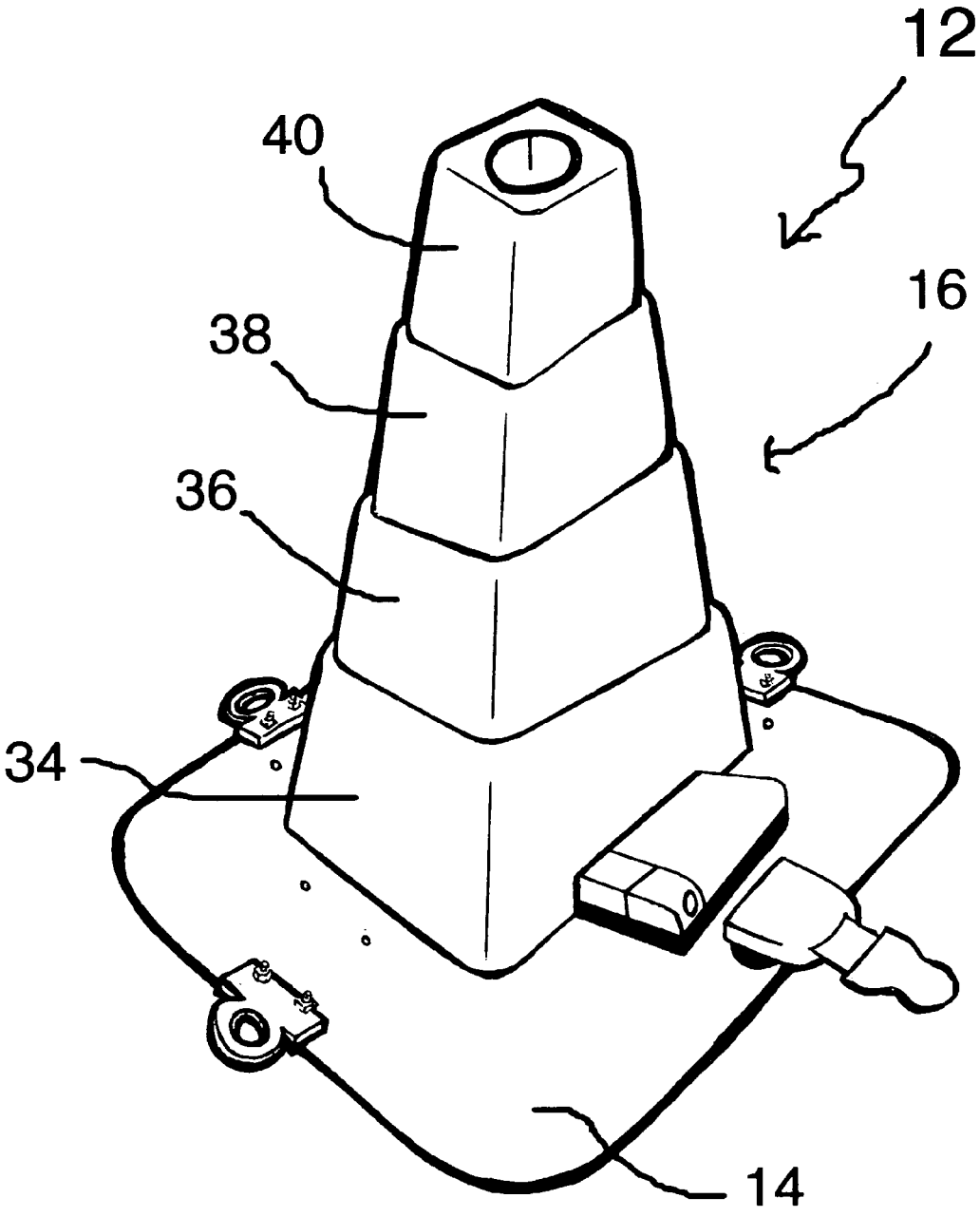
FIG. 4 is a perspective view of a second preferred embodiment of the present invention.

Conical cap 16 comprises a nesting plurality of conical segments 34, 36, 38, 40, and 42. (The number of conical segments can vary depending on the projected size of the cone; compare FIGS. 2 and 4.) Conical segments 36–42 are capable of collapsing within segment 34 for storage and of extending into the full-sized cone shown in FIGS. 1–2. Conical segments 34–42 are shown as generally circular in horizontal cross-section in FIGS. 2–3. It is envisioned that conical segments 34–40 could also be rectangular or square in horizontal cross-section as shown in FIG. 4.

Any known means for constraining conical segments 34–42 in their extended state can be employed without departing from the spirit of the invention. Two preferred modes are shown in FIGS. 5–6.

Figure 5A:
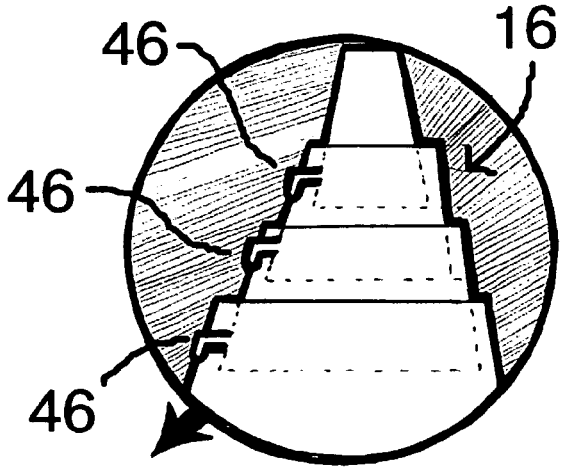
FIG. 5A is a partial perspective view of the first preferred embodiment showing a side view of the constraining mechanism of FIG. 5.
Figure 5:
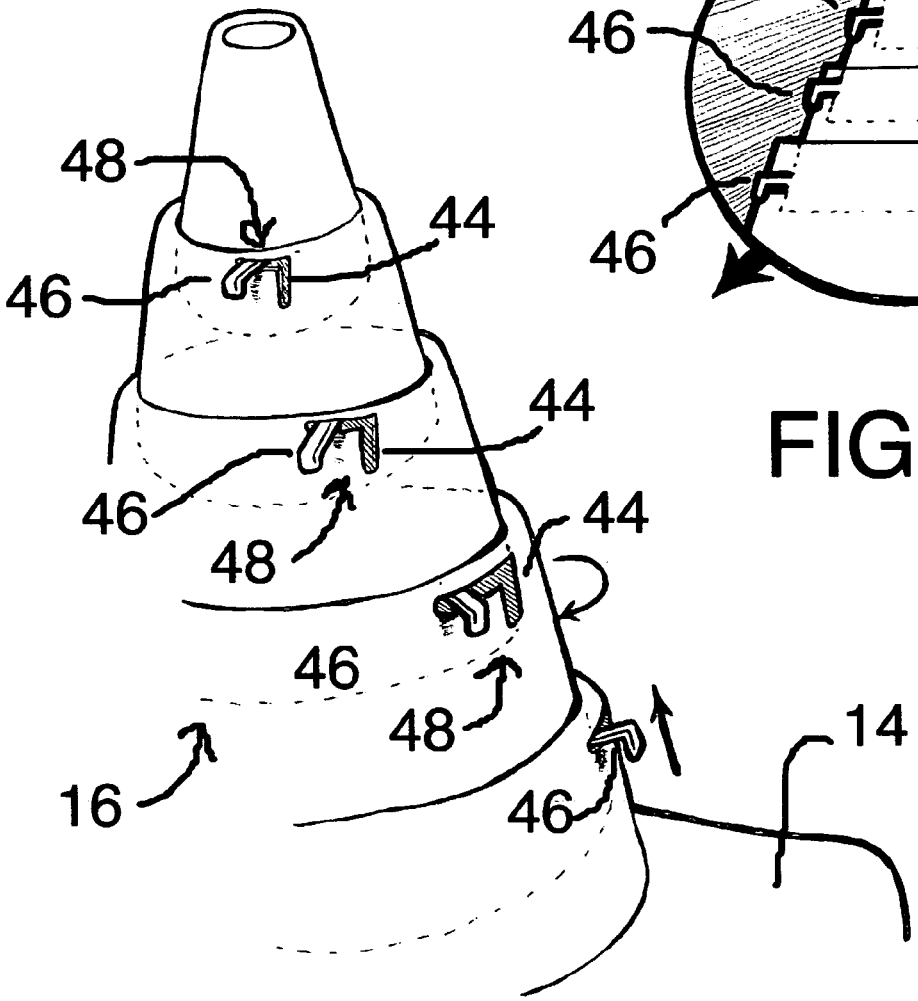
FIG. 5 is a partial perspective view of the first preferred embodiment of the present invention showing a constraining mechanism therefor.
Figures 6, 6A:
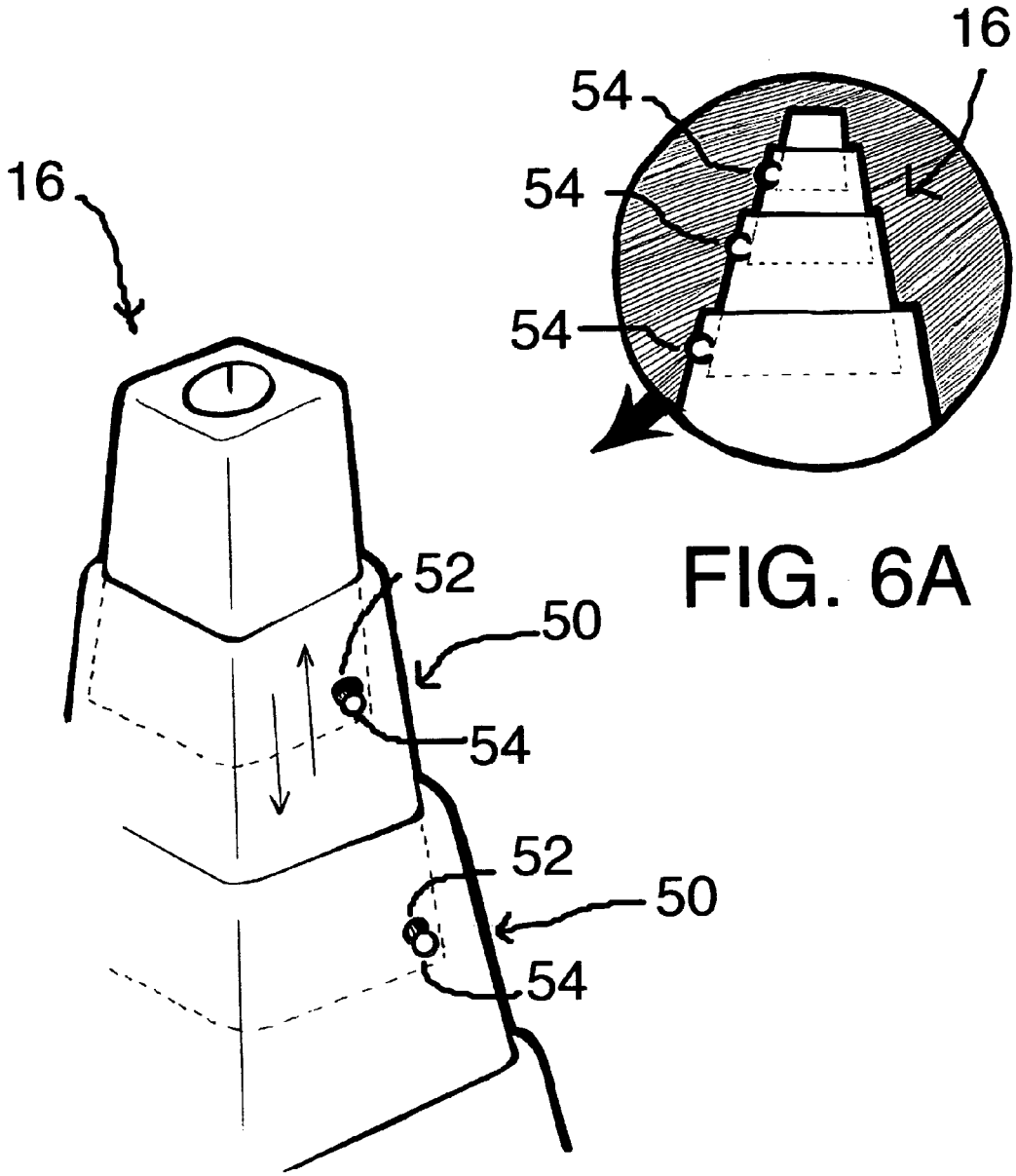
FIG. 6 is a partial perspective view of the second embodiment of the present invention showing a second embodiment of a constraining mechanism for use therewith.
FIG. 6A is a partial perspective view of the second embodiment showing a side view of the constraining mechanism of FIG. 6.

In FIG. 5, each of the conical segments below the top one, namely, conical segments 34–40, includes an inverted L-shaped slot 44 through an upper portion of the conical segment. Conical segments 36–42, i.e., each of the conical segments above the bottom one, includes an L-shaped latch 46 projecting from its outer surface (FIG. 5A). A constraining mechanism 48 is formed by the combination of slot 44 and latch 46. Engagement of latch 46 with the horizontal leg of inverted L-shaped slot 44 of the next-lower conical segment maintains the two segments in the extended state. When latch 46 is aligned with the vertical leg of inverted L-shaped slot 44 and lowered, the upper conical segment descends within the lower conical segment to collapse them together into a nested relationship. The length of the vertical leg of inverted L-shaped slot 44 controls the degree of nesting of the conical segments.

Expansion is easily and quickly effected by lifting and twisting conical segment 42 clockwise. Conical cap 16 is collapsed by a reverse motion, twisting conical segment 42 counter-clockwise and lowering it. A selected angular separation of each conical segment's slot 44 and hook 46 produces the staggered array of constraining mechanisms 48 shown in FIG. 5. Staggering constraining mechanisms 48 improves the strength and stability of conical cap 16.

Constraining mechanism 50 of the pyramid-style conical cap 16 (FIG. 6) comprises a keyhole-shaped slot 52 coacting with a bulbous latch 54. Keyhole slot 52 is located near the top of each conical segment 34–38. Bulbous latch 54 is fixed near the bottom of each conical segment 36–40. Keyhole slot 52 and bulbous latch 54 are vertically aligned with each other, the alignment being maintained by the rectangular or square cross-sectional shapes of the conical segments.

To disengage locking mechanism 50, conical segment 40 is lifted to align each latch 54 with the upper, larger portion of its corresponding keyhole slot 52, and latches 54 are sequentially depressed until they clear the interior surface of the conical segment, whereupon each higher segment is lowered into the lower one. The flexibility of the walls of each conical segment permits the depression and withdrawal of latch 54 from its corresponding slot 52. Expansion is as simple as lifting conical segment 40 until all latches 54 align with the upper, larger portion of its corresponding keyhole slot 52, holding it there momentarily while the resiliency of the flexible walls pop latches 54 into slots 52, and lowering the conical segments to fit bulbous latches 54 into the lower, narrower portion of keyhole slots 52, quicker to do than to explain. Collapsing the pyramidal conical cap 16 is clearly more time consuming than expanding it, but time is more important when setting up the cones than is cleaning up afterwards, especially for motorists with stalled automobiles.

Referring to FIG. 7, light module 32 is provided on at least the lead cone 12 in order to initially alert the motorist of the upcoming lane maker 10. Of course, a light module 32 can obviously be attached to any of cones 12. Also, a light module 32 can obviously be attached as well as to any existing cone, collapsible or not. Light module 32 comprises a sensor 56, electronic circuitry 58, preferably including a programmable CPU, a light 60, and a mounting plate 62. There are various modes of operation for light module 32, hereinafter described, and the type of sensor 56 and electronic circuitry 58 will vary accordingly.

A principle mode of operation has light 60 remain off until traffic cone 12 is being approached, at which time light 60 is turned on. Sensor 56 can be a motion sensor responsive to any oncoming entity. Or, sensor 56 could be programmed to respond to the sound frequencies uniquely associated with vehicular traffic. A light sensor responsive to the headlights of approaching traffic could trigger light 60 to become illuminated. Naturally, in any of these modes, electronic circuitry 58 can be programmed to cause light 60 either to flash or to shine continuously. The virtue of this mode of operation is that the power for light 60, most likely from a battery, would be used only when needed and thereby be conserved.

Alternatively, sensor 56 could be made responsive to light levels, and turn on light 60 when the level drops below a given threshold level, such as after sunset or when inclement weather decreases the overall light level.

Finally, it is within the scope of the invention to include a manual switch (not shown) to activate light 60 at the will of the user. Mounting plate 62 is preferably adhesively affixed to the bottom of the housings for sensor 56, electronics 58, and light 60. Threaded bolts 64 extend from the base of mounting plate 62 for attaching light module 32 to the base 14 of traffic cone 12 by means of apertures 30 (FIG. 3). Of course, one could attach up to four light modules 32 to base 14, but it has been found sufficient to provide only one positioned to face the oncoming traffic.

A major feature of the instant invention resides in the provision of lane markers 18, particularly lane markers having a rotatable housing 20. As exemplified by FIG. 1, it is rare for all the cones 12 to rest along a straight line, and even more rare for even two of the bases 14 to be symmetrically, angularly oriented. Any three cones will normally form an acute angle and their bases will point in any direction. This can occur intentionally. For instance, when closing off a roadway lane, the first of cones 12 is placed adjacent the side of the road, the next approximately in the middle of the lane to be closed, and thereafter cones are spaced along the existing dotted or dashed lane markers. Uneven relative positioning also occurs naturally due to the road turning, the truck drifting off-line, and the worker's inattention to alignment. Functionally, how the cones are aligned or oriented is not a safety consideration, so relative positioning of cones 12 does not matter and is not usually of pressing concern.

Where connecting fencing is required, however, relative positioning of the cones becomes an efficiency issue. As aforementioned, since the bases will be rotatively cocked relative to each other, prior art cones must be rotated after placement on the road in order to interconnect the fencing, a time-consuming, labor-intensive operation. Further, in systems such as proposed by Lees, Johnsen, and Falcon, where the distances between cones are fixed due to the structural dimensions of the interconnecting barriers, not only does the orientation of the cones need to be adjusted but also the distances between them.

Figure 9:
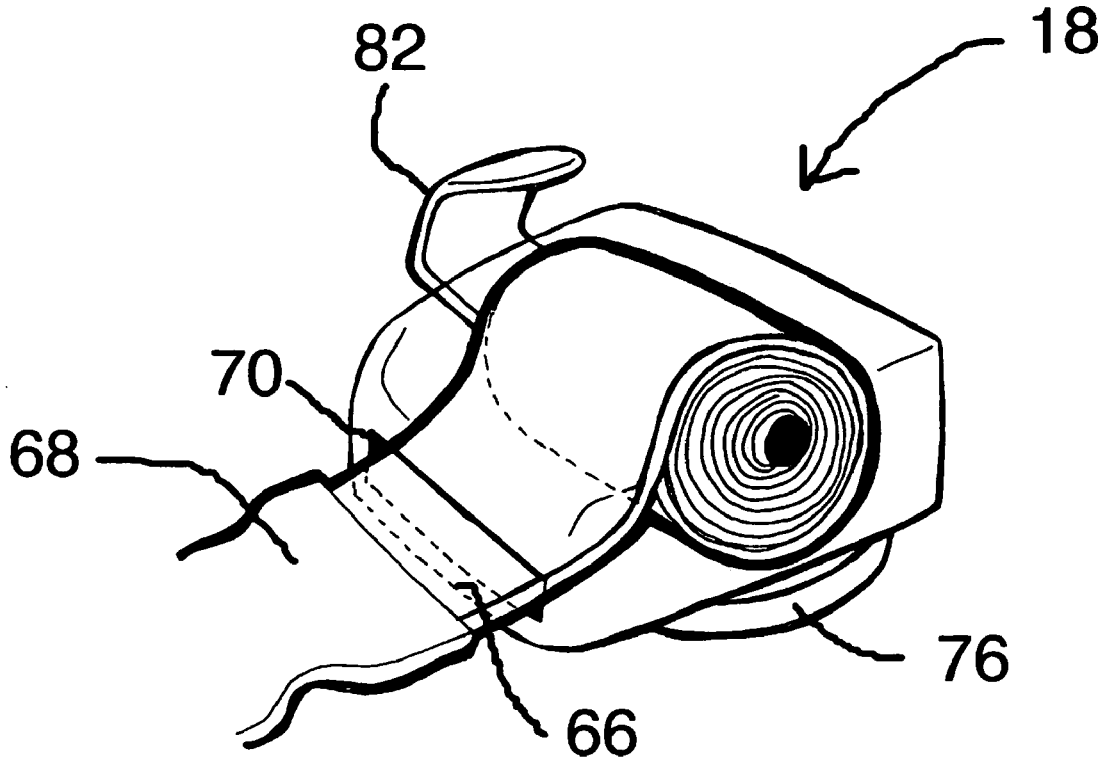
FIG. 9 is a see-through perspective view of the lane marker of FIG. 8 showing internal details thereof.

Refer now to FIGS. 8–9 and 13–14 where two embodiments of the lane marker 18 are shown. Marker 18 comprises a housing 20, a retractable tape 66, and a hitch 68 attached to the free end of tape 66. Retractable tape 66 is preferably made of a durable web-like material which is sufficiently flexible to coil within a housing 20 and, preferably, highly visible, e.g., comprising electro-fibers, solar fibers, glass-beaded webs, or other ultra-bright reflective material. The other end of retractable tape 66 is attached to a conventional spring-loaded retracting mechanism within housing 20, where it is coiled when retracted (FIG. 9). Tape 66 passes through a slot 70 located along one side of housing 20.

Figure 14:
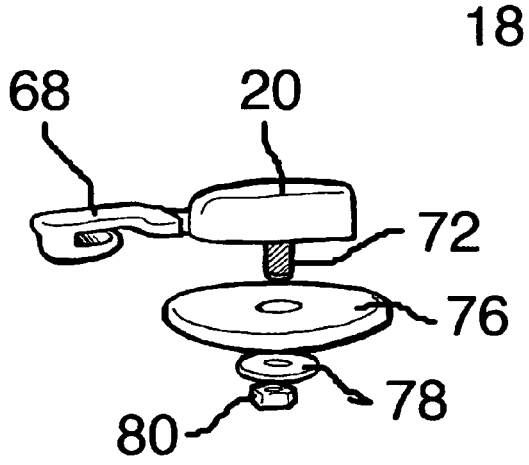
FIG. 14 is a side view of the lane marker of FIG. 13 showing the components for attaching it to a traffic cone.

As seen more clearly in FIG. 14, lane marker housing 20 has a single, depending threaded bolt 72 by which it is rotatably mounted on base 14 of traffic cone 12. Mounting bolt 72 passes through aperture 22 in base 14 (FIG. 3). A low friction washer 76, preferably made of Teflon™ or similar material, is interposed between housing 20 and the top surface of base 14 to facilitate rotation of housing 20 around mounting bolt 72. Only one low friction washer is shown in the drawings, but it is contemplated that one could be provided for both the top and bottom surfaces of base 14, if needed to facilitate rotation of housing 20. A washer 78 and lock nut 80 complete the attachment of lane marker 18 to traffic cone 12.

In the first embodiment of lane marker 18 (FIGS. 8–9) a locking mechanism 82 locks tape 66 at whatever length it has been extended. Preferably, locking mechanism 82 is spring-loaded in the direction of arrow 84 into its locked state. Pressure applied to locking mechanism 82 in the direction of arrow 86 unlocks tape, allowing the spring within housing 20 to retract tape 66 therein.

The second embodiment of lane marker 18 (FIGS. 13–14) differs from the first by the elimination of locking mechanism 82. There are advantages of and drawbacks to each embodiment. For instance, tape 66 is easier to handle with the first embodiment, since the user is not constantly fighting the spring's retracting forces. But, the second embodiment allows tape 66 to retract to comparative safety within housing 20 should the hitch become unattached or broken. In the event that a cone 12 is struck by an errant vehicle, moving it out of its position in the line of cones, the new lanes indicated by lane markers 18 are not those intended. Hitches 68 are designed either to become unattached to anchors 26, due to the rotational torques imposed on tape 66 by the cone tipping over, or to break away from tape 66, when subjected to a force beyond a preselected threshold. Either way, tape 66 will retract within housing 20. No false lane is thereby indicated, nor does a flapping tape distract the motorist from safely traversing the scene.

As aforementioned, rotatable lane marker 18 is attached along one side of peripheral edge 24 of base 14 (FIGS. 2–4), and a lane marker anchor 26 is attached along each of the other sides of edge 24. Anchor 26 (FIG. 12) comprises a mounting flange 90 with a circular staple 92 extending from one edge thereof. Staple 92 includes an enlarged circular hole 94 extending therethrough. A pair of bolts 96 pass through apertures 28 in base 14 (FIG. 3) and are secured thereto by nuts 98.

Lane marker 18 can advantageously be added to existing traffic control cones to provide them with the ease of placement as well as to the disclosed cones 12.

Figure 10:
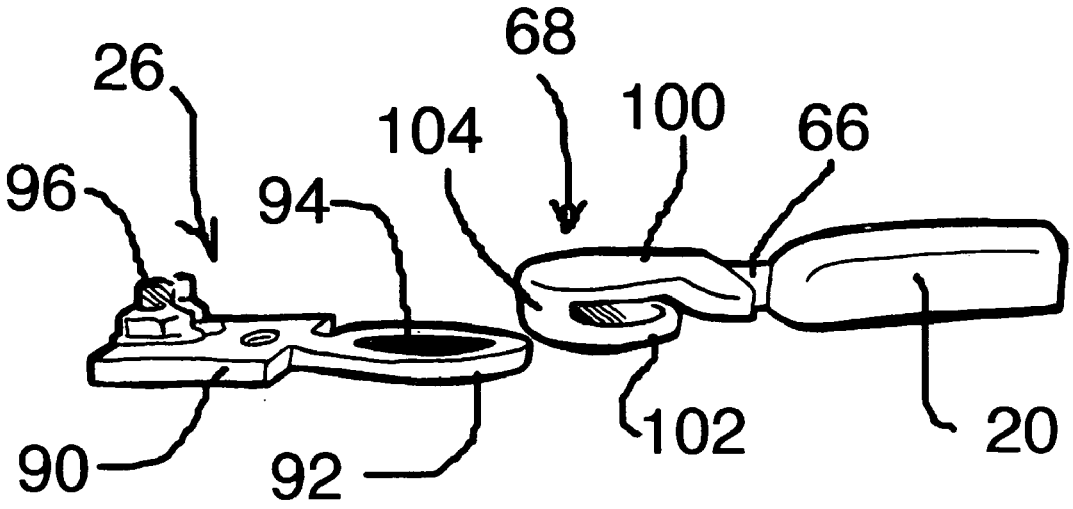
FIG. 10 is a perspective view of a lane marker anchor and a hitch on the free end of the lane marker of FIG. 8.
Figure 11:
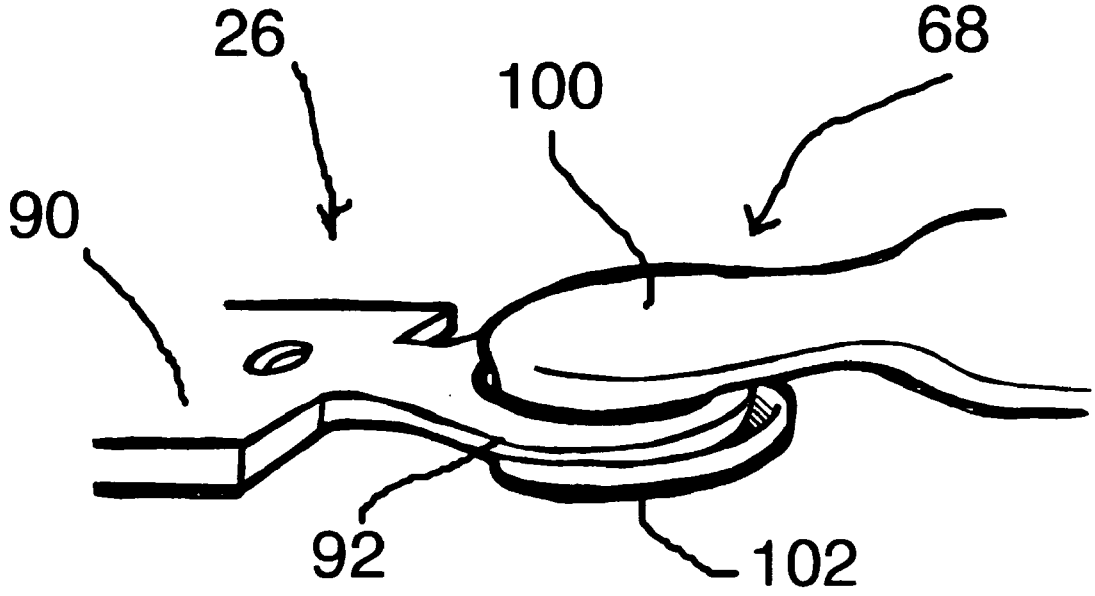
FIG. 11 is a perspective view of the anchor and hitch of FIG. 10 latched together.
Figure 12:
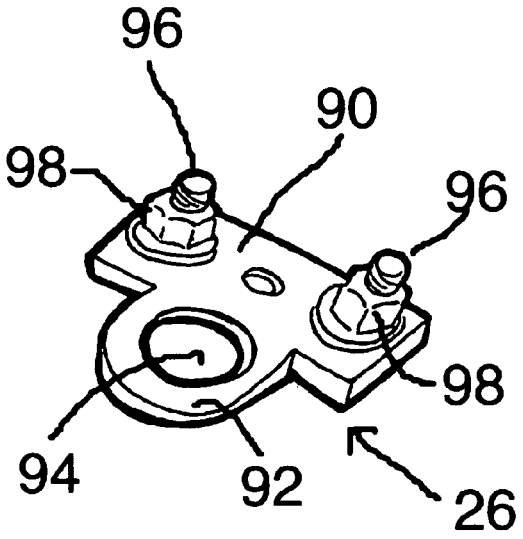
FIG. 12 is an enlarged perspective view of the anchor of FIGS. 10–11.
Figure 13:
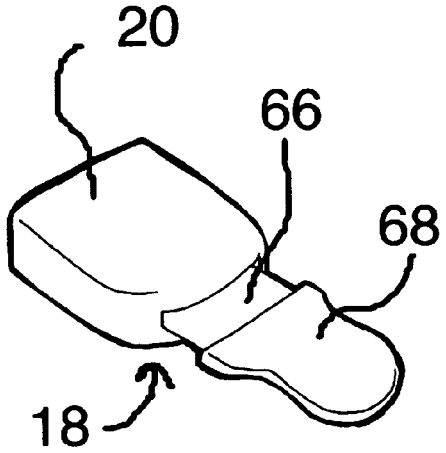
FIG. 13 is a perspective view of a second embodiment of a lane marker.

FIGS. 10 and 11 illustrate the connection between hitch 68 and its associated anchor 26. Hitch 68, as most clearly seen in FIG. 10, comprises a body 100 terminating in a U-shaped hook 102. The interior surface of the bight 104 of U-shaped hook 102 is arcuate with a radius of curvature equal to the radius of circular hole 94.

Referring again to FIG. 1, adjacent cones 12 are interconnected by connecting one cone's hitch 68 to another's anchor 26 by extending tape 66 between the cones and connecting hook 102 to one of the staples 92 on the next cone 12. Lane marker housing 20 rotates to face the adjacent cone, so that tape 66 extends directly toward it. As such, there is no crimping, twisting, or other unnatural deformations of tape 66 which could cause failure thereof. Further, by the contacting surfaces of circular hole 98 and hook 102, the transfer of forces between hook 102 and staple 92 is distributed over the maximum area, adding to the strength of the connection, regardless of the relative positioning and orientations of the adjacent cones. It is this ability to adapt to the relative positioning and orientations of the adjacent cones that allows for quick and easy assembly of a traffic control system 10, without having to resort to the time consuming task of repositioning or rotating the cones.

When attached between two adjacent cones, tape 66 lies flat on the ground. Vehicles can drive over tape 66 without damage to it. Thus, the instant invention combines two desirable features in one structure, namely, the lane boundary is clearly marked by a highly reflective tape, and official trucks, cars, or other vehicles can easily pass over it in the performance of their duties without disrupting the visual effect.

The placement of light 60 on base 14 immediately behind tape 66 has operative advantages. Light from light 60 reflects off the bright surface of tape 66 directly toward the oncoming motorists, illuminating it above and beyond any ambient reflections.

Figure 15:
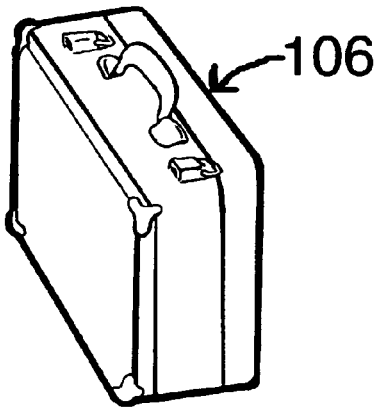
FIG. 15 is a perspective view of a carrying-case for a plurality of the inventive cones of FIGS. 1 and/or 4.
Figure 16:
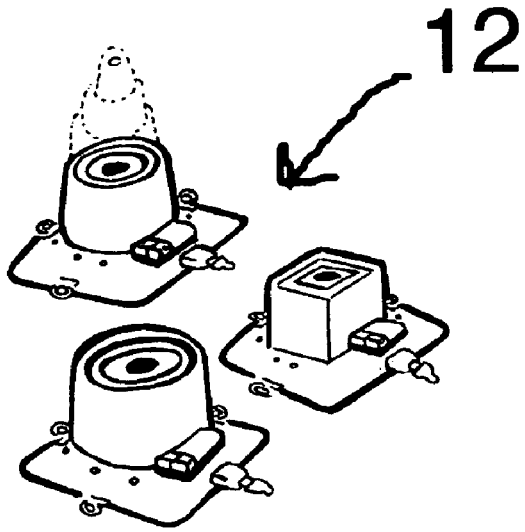
FIG. 16 is a perspective view of the inventive cones of FIGS. 1 and/or 4 in their collapsed state for storage.
Figure 17:
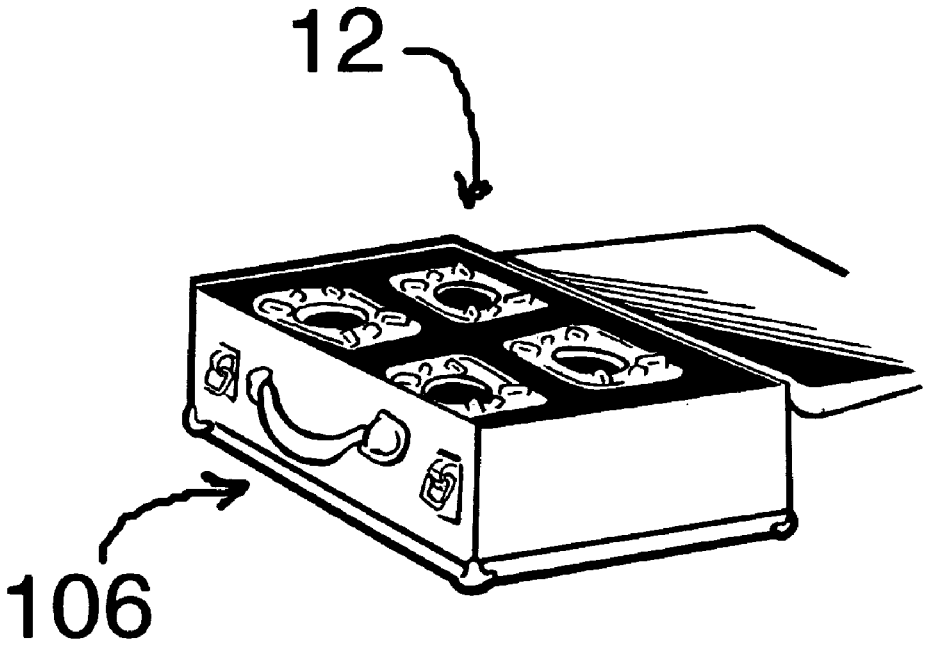
FIG. 17 is a perspective view of the collapsed cones as housed in the carrying-case of FIG. 15.

Referring now to FIGS. 15–17, storage and transporting of a plurality of cones is shown. Cones 12 are collapsible, thereby reducing their extended height, as shown in phantom in FIG. 16. Once collapsed, cones 12 are stored in a suitcase 106. The combination is clean and well organized which facilitates carrying and using them. This is especially important for ordinary motorists, for the suitcase 106 is easily stored in the trunk of a car, quickly removed therefrom as a unit, and the cones are quickly and easily extracted, opened, and arranged into a protective lane maker 10.

It is clear from the above that the objects of the invention have been fulfilled.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the foregoing Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It can be seen from the above that an invention has been disclosed which fulfills all the objects of the invention. It is to be understood, however, that the disclosure is by way of illustration only and that the scope of the invention is to be limited solely by the following claims:

I claim as my invention:

1. A lane maker, comprising:

a plurality of interconnected traffic control cones, each of said traffic control cones comprising:

a base, said base including a lane marker rotatably attached thereto and said base including at least one anchor integral therewith;

said lane marker comprising a housing, a planar tape, said planar tape being retractable within said housing, and a hitch at the free end of said tape, said hitch being configured to be releasably connected to an anchor on an adjacent cone, said base, housing, planar tape, and hitch being oriented such that when connecting two adjacent cones, said planar tape lies substantially flat on the ground between said two adjacent cones; and a conical cap extending upwardly from said base.

2. A lane maker as in claim 1 further comprising a light module mounted on said base adjacent said lane marker.

3. A lane maker as in claim 2 wherein said light module comprises a sensor, an electronic circuit, and a light, said sensor being responsive to external conditions to control the status of said light.

4. A lane maker as in claim 3 wherein said sensor is responsive to one of the following external conditions: motion, audible sounds, incident light, and the level of ambient light.

5. A lane maker as in claim 3 wherein said tape comprises a highly visible, web-like material, said material being flexible enough to coil within said housing, and, when said light is turned on, said light is located to shine on said tape to illuminate it.

6. A lane maker as in claim 1 wherein said hitch is designed either to become unattached to the anchor to which it is attached, due to the rotational torques imposed on said tape by said cone tipping over, or to break away from said tape, when subjected to a force beyond a preselected threshold.

7. A lane maker as in claim 1 wherein said tape comprise a material from one of the following: electro-fibers, solar fibers, glass-beaded webs, and an ultra-bright reflective material.

8. A lane maker as in claim 1 wherein said cones are color-coded to indicate the type of activity from which the traffic is being separated.

9. A traffic control cone as in claim 1 wherein said conical cap comprises a plurality of conical segments including a bottom segment integral with said base, said plurality of conical segments being capable of being collapsed to nest within said bottom segment and capable of extending into a full-sized cone.

10. A traffic control cone as in claim 9 further comprising manually operable constraining means for maintaining said plurality of conical segments in said extended, full-sized cone status.

11. A traffic control cone as in claim 9 wherein the horizontal cross-section of said plurality of conical segments are one of the following: circular, rectangular, and square.

12. A traffic control cone, comprising:

a base, said base including a lane marker rotatably attached thereto and said base including at least one anchor integral therewith;

said lane marker comprising a housing, a planar tape, said planar tape being retractable within said housing, and a hitch at the free end of said tape, said hitch being configured to be releaseably latched to said anchor, and said base further including a planar bottom surface and said planar tape extending from said housing substantially parallel to said planar bottom surface; and a conical cap extending upwardly from said base.

13. A traffic control cone as in claim 12 further comprising a light module mounted on said base.

14. A traffic control cone as in claim 13 wherein said light module comprises a sensor, an electronic circuit, and a light, said sensor being responsive to external conditions to control the status of said light.

15. A traffic control cone as in claim 14 wherein said sensor is responsive to one of the following external conditions: motion, audible sounds, incident light, and the level of ambient light.

16. A traffic control cone as in claim 13 wherein said light module is mounted on said base behind said lane marker, and, when said light is turned on, said light shines on said tape to illuminate it.

17. A traffic control cone as in claim 12 wherein said tape comprises a highly visible, web-like material, said material being flexible enough to coil within said housing.

18. A traffic control cone as in claim 17 wherein said hitch is designed either to become unattached to the anchor to which it is attached, due to the rotational torques imposed on said tape by said cone tipping over, or to break away from said tape, when subjected to a force beyond a preselected threshold.

19. A traffic control cone as in claim 17 wherein said tape comprise a material from one of the following: electro-fibers, solar fibers, glass-beaded webs, and an ultra-bright reflective material.

* * * * *